US007240464B2

(12) United States Patent
Oliphant et al.

(10) Patent No.: US 7,240,464 B2
(45) Date of Patent: Jul. 10, 2007

(54) CONNECTOR FOR CONCRETE POLES

(75) Inventors: Wesley James Oliphant, Tomball, TX (US); Robert Charles Wingard, Bartow, FL (US)

(73) Assignee: Newmark International, Inc., Birmingham, AL (US)

( * ) Notice: Subject to any disclaimer, the term of this patent is extended or adjusted under 35 U.S.C. 154(b) by 0 days.

(21) Appl. No.: 10/206,277

(22) Filed: Jul. 27, 2002

(65) Prior Publication Data

US 2006/0086060 A1 Apr. 27, 2006

(51) Int. Cl.
*E04C 3/30* (2006.01)

(52) U.S. Cl. ..... 52/721.2; 248/218.4; 52/736.2

(58) Field of Classification Search ..... 52/726.4, 52/736.2, 721.2, 720.3, 736.3, 721.9, 732.1, 52/740.6, 736.1, 72.2, 125.5; 362/431; 248/218.4
See application file for complete search history.

(56) References Cited

U.S. PATENT DOCUMENTS

| | | | | |
|---|---|---|---|---|
| 374,103 | A | | 11/1887 | Wilson |
| 822,499 | A | | 6/1906 | Ancona |
| 841,064 | A | | 1/1907 | Stanley |
| 1,029,207 | A | | 6/1912 | Megahan |
| 1,052,990 | A | * | 2/1913 | Zillgitt |
| 1,075,232 | A | | 10/1913 | Stout |
| 1,244,652 | A | | 10/1917 | Southgate |
| 1,268,325 | A | | 6/1918 | Cole |
| 1,777,509 | A | | 10/1930 | Underwood |
| 2,358,343 | A | | 9/1944 | Maxey |
| 2,702,103 | A | | 2/1955 | Pfistershamer |
| 2,721,719 | A | | 10/1955 | Giese |
| 3,317,170 | A | | 5/1967 | Pfaff, Jr. |
| 3,339,953 | A | * | 9/1967 | Bohn ..... 403/387 |
| 3,349,531 | A | * | 10/1967 | Watson ..... 52/296 |
| 3,501,881 | A | | 3/1970 | Van Buren |
| 3,571,991 | A | | 3/1971 | Doocy et al. |
| 4,069,629 | A | | 1/1978 | Piazza |
| 4,320,606 | A | | 3/1982 | GangaRao |
| 5,205,690 | A | | 4/1993 | Roth |
| 5,505,554 | A | * | 4/1996 | Lautenschlager Horst et al. ..... 403/12 |
| 5,611,176 | A | | 3/1997 | Juengert et al. |
| 5,623,804 | A | * | 4/1997 | Kelly et al. ..... 52/704 |

(Continued)

FOREIGN PATENT DOCUMENTS

| | | |
|---|---|---|
| DE | 35 45 920 | 6/1987 |
| FR | 2 708 680 | 2/1995 |
| WO | WO 02 33185 | 4/2002 |

OTHER PUBLICATIONS

Newmark's drawing of product on sale as of Jul. 27, 2001.

*Primary Examiner*—Anita King
*Assistant Examiner*—Steven M. Marsh
(74) *Attorney, Agent, or Firm*—Camoriano and Associates; Theresa Fritz Camoriano

(57) ABSTRACT

A concrete pole includes an attachment mechanism which provides a structurally sound means of attaching to the pole and permits the use of short, inexpensive bolts. The attachment mechanism includes reinforcing bars, a base plate, an internally threaded fastener insert fixed to the base plate, which provides a path from the base plate, which is embedded in the concrete pole, to the finished outside surface of the pole. One embodiment includes a pipe connecting opposing fastener inserts for added strength.

20 Claims, 6 Drawing Sheets

U.S. PATENT DOCUMENTS 5,761,875 A 6/1998 Oliphant et al.
5,826,387 A * 10/1998 Henderson et al. ..... 52/295
5,941,485 A * 8/1999 Davidson et al. ..... 248/218.4
6,007,285 A * 12/1999 Sisto et al. ..... 411/344
6,189,286 B1 * 2/2001 Seible et al. ..... 52/721.4
6,446,411 B2 * 9/2002 Natelli, Jr. ..... 52/730.1
6,491,272 B1 * 12/2002 Franks ..... 248/218.4
6,595,323 B2 * 7/2003 Lindsey et al. ..... 182/92
6,893,199 B2 * 5/2005 Michels ..... 411/340

* cited by examiner

CONNECTOR FOR CONCRETE POLES

BACKGROUND OF THE INVENTION

The present invention relates to concrete poles, and, in particular, to an attachment mechanism for a concrete pole which permits items to be bolted to the pole.

In the prior art, the most common way to attach structural appurtenances to a centrifugally cast concrete pole is to pass bolts completely through the pole and connect nuts to the bolts on the opposite side of the pole. This requires casting or drilling holes through the pole, which is labor intensive. Even more importantly, this means that, in order to attach anything near the base of the pole, which can have a very large diameter, very long bolts are required. These long bolts are very expensive, and, in order to be able to attach to the pole at a variety of different heights on a tapered pole, a variety of different length bolts must be stocked, which is also very expensive.

Also, since the centrifugally cast concrete poles are hollow and relatively thin-walled, the bolts are not very well supported by the pole and therefore cannot support much attachment load.

U.S. Pat. No. 5,761,875, Reinforced Concrete Pole with Attachment Mechanism, issued Jun. 9, 1998, which hereby incorporated by reference, discloses an improved attachment mechanism which introduces the use of shorter, standard size bolts, as well as material and labor cost savings, and improves the versatility of the concrete poles. However, as is discussed in more detail in the specification, this improvement has weaknesses, including a cantilevered load on the nuts and bolts securing the attachment to the pole.

SUMMARY OF THE INVENTION

The present invention provides an attachment mechanism which does not require drilling through the concrete pole in order to attach items to the pole, thereby saving labor. Also, the present invention provides an attachment mechanism which permits a single length bolt to be used to attach items to the pole at any elevation on the pole, even though the thickness of the concrete may vary and the diameter of the pole may vary with elevation, thereby permitting the use of less expensive bolts and permitting the stocking of only a single length bolt, which saves considerable cost.

The present invention also provides an attachment mechanism which provides excellent support to anything that is bolted onto the attachment mechanism, allowing heavier loads to be attached to the pole or providing better support for the same load than prior designs. Furthermore, the bolts are not supporting a cantilevered load, but are instead supported the length of the bolt by the concrete pole.

DESCRIPTION OF THE PREFERRED EMBODIMENTS

Figure 1:
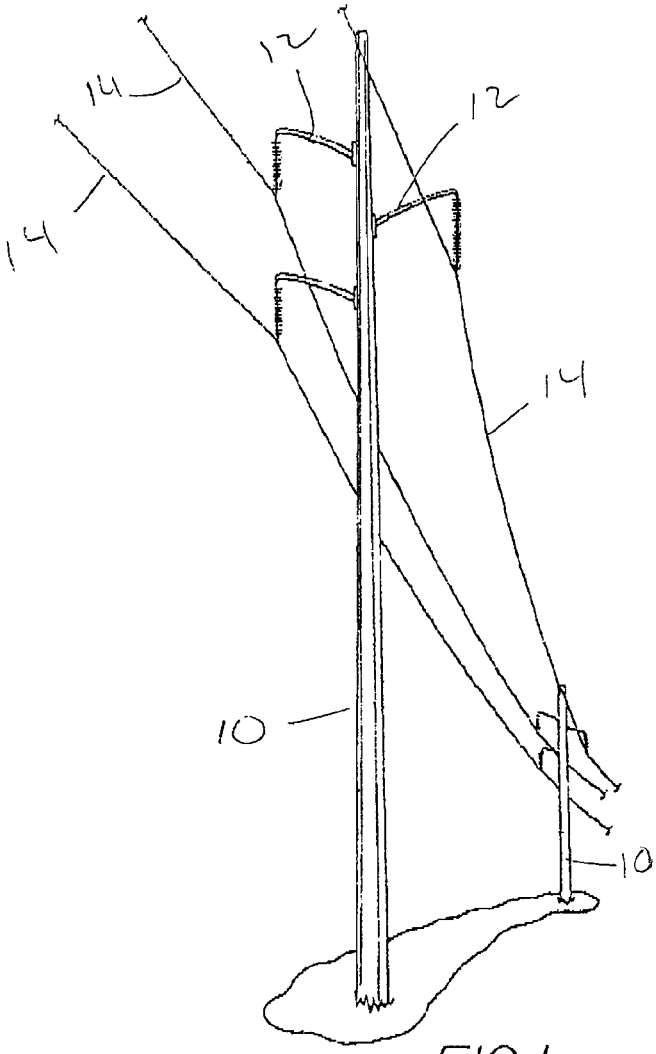
FIG. 1 shows an example of a centrifugally cast concrete pole made in accordance with the present invention, with arms attached to the pole.

FIG. 1 shows an example of a plurality of concrete poles 10, used for carrying electric power. Of course, it is known that similar poles could be used for other purposes, such as to support lighting fixtures, communications antennas, signs, and other structures. In this view, each pole 10 has three arms 12 attached to the pole 10, and the arms 12 carry the power lines 14.

Figure 2:
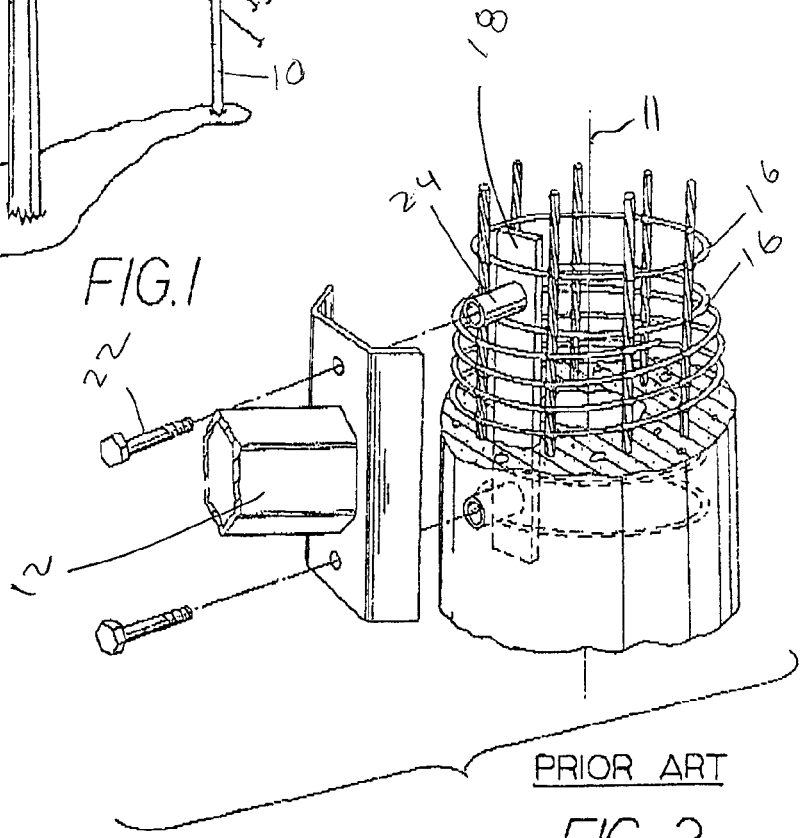
PRIOR ART FIG. 2
FIG. 2 is a broken away, perspective view, partially in section, of a centrifugally cast concrete pole of the prior art, with vertical reinforcing rods or prestressing strands, a spiral reinforcement, and bolts extending to a plate embedded in the pole in order to attach an arm to the pole.

FIG. 2 shows our previous invention for connecting the arms to the pole. The pole defines a central vertical axis 11. A vertical base plate 18 has annular members or rings 16 welded to it. Between the top two rings 16, a hole is drilled through the base plate 18, and a threaded nut (not shown) is welded to the inner surface of the base plate 18 at the hole. Also, a piece of pipe or tube 24 is fixed to the outer surface of the base plate 18 and projects outwardly from the base plate 18 through the top two rings 16, at the hole. The tube 24 is long enough that, as the concrete is poured, the unattached end of the tube 24 projects just beyond the outer surface of the concrete pole, leaving a path from the outside of the pole 10 to the nut. The pipe 24 surrounds the hole, so that a bolt 22 can extend through the pipe 24 and be threaded into the nut. One drawback of this prior art design is that the arm 12, secured to the concrete pole 10 via the bolts 22, creates a cantilevered load on the bolts 22. The arm 12 imposes a vertical load on the bolts 22 at the face or outer surface of the pole 10, while the bolts 22 are secured to the nut and thus to the base plate 18 inside the pole 10, some radial distance away from the surface of the pole 10. Thus, the load imposed by the arm 12 is a cantilevered load with a moment arm equal to the distance from the outer surface of the pole 10 to the nut welded to the inner surface of the base plate 18.

Figure 3:
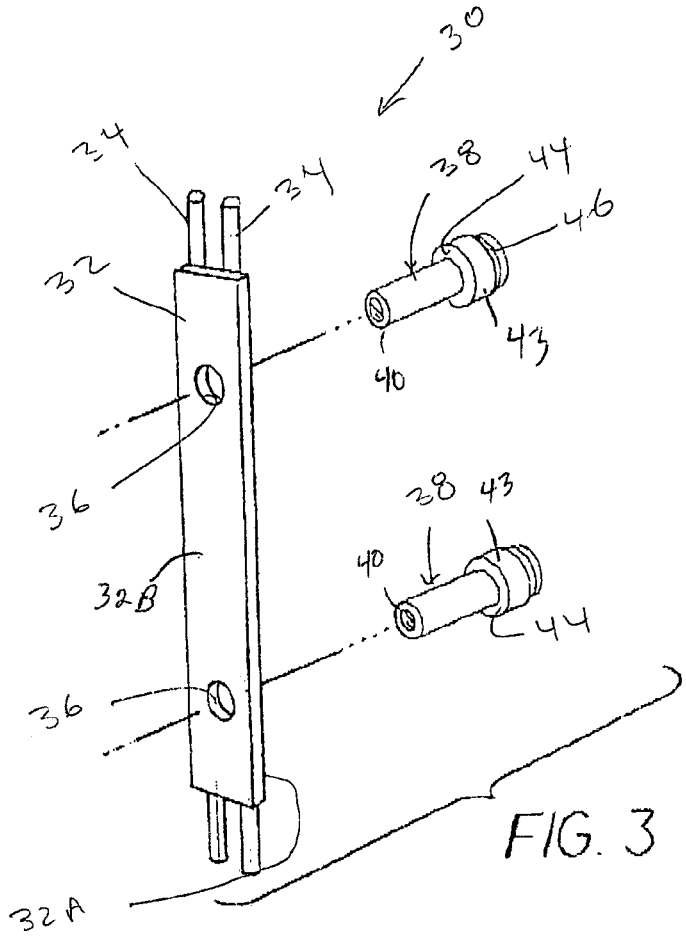
FIG. 3 is an exploded perspective view of a portion of the attachment mechanism used in the pole of FIG. 1.

FIGS. 3–7 show a first embodiment of an attachment assembly for the concrete pole 10. FIG. 3 is an exploded view of an attachment mechanism 30, including a substantially vertical base plate 32, having an inner surface 32A, facing toward the central vertical axis 11 of the pole 10, and an outer surface 32B, facing away from the central vertical axis 11. Two substantially vertical reinforcing bars 34 are secured, as by welding, to the inner surface 32A and define a space between the reinforcing bars 34. The base plate 32 defines upper and lower, vertically-aligned holes 36, aligned with the space between the reinforcing bars 34. Insert fasteners 38 are secured, also as by welding, to the base plate 32 at the holes 36 as explained below.

Figure 6:
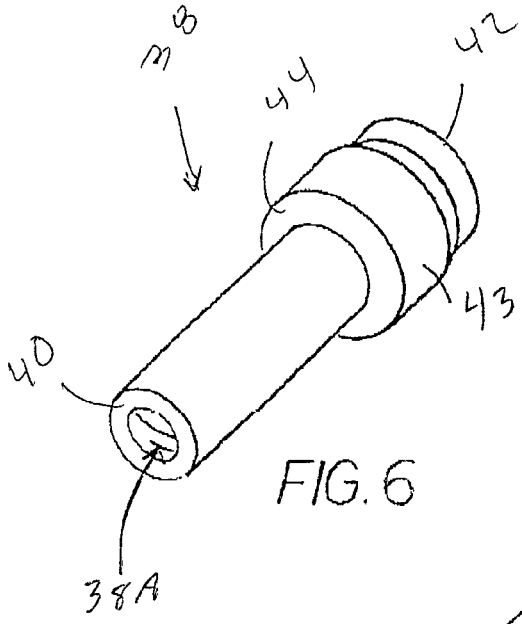
FIG. 6 is a perspective view of one of the insert fasteners of FIG. 3.
Figure 7:
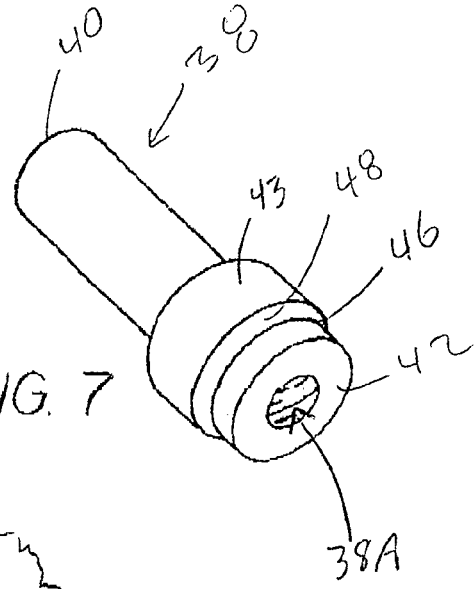
FIG. 7 is a perspective view of the opposite end of the insert fastener of FIG. 6.
Figure 8:
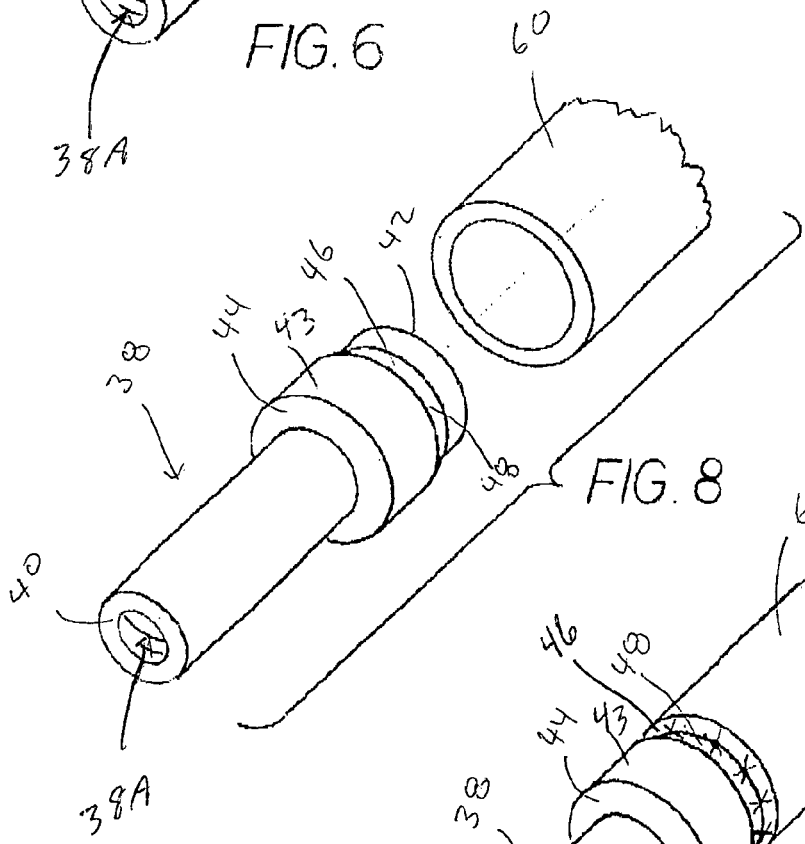
FIG. 8 is an exploded perspective view of the insert fastener of FIG. 6 combined with a pipe, which, when assembled, become part of a second embodiment of the pole attachment mechanism of the present invention, shown in FIG. 10.

As seen in FIGS. 6 and 7, each of the insert fasteners 38 has first and second ends 40, 42, respectively, and defines internal threads 38A throughout a substantial portion of its length. Each insert fastener 38 has an enlarged annular portion 43 between its first and second ends 40, 42. The enlarged annular portion 43 defines an outer shoulder 44 and an inner shoulder 46. The inner shoulder 46 defines a beveled edge 48.

Figure 4:
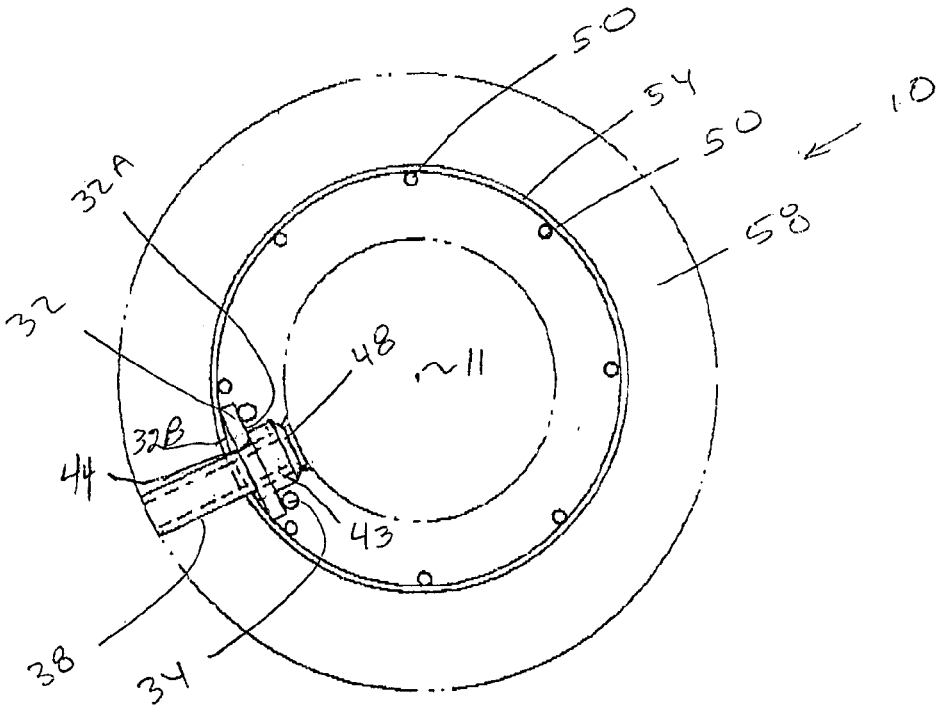
FIG. 4 is a schematic top view of the assembled attachment mechanism used in the pole of FIG. 1, with the concrete shown in phantom.
Figure 5:
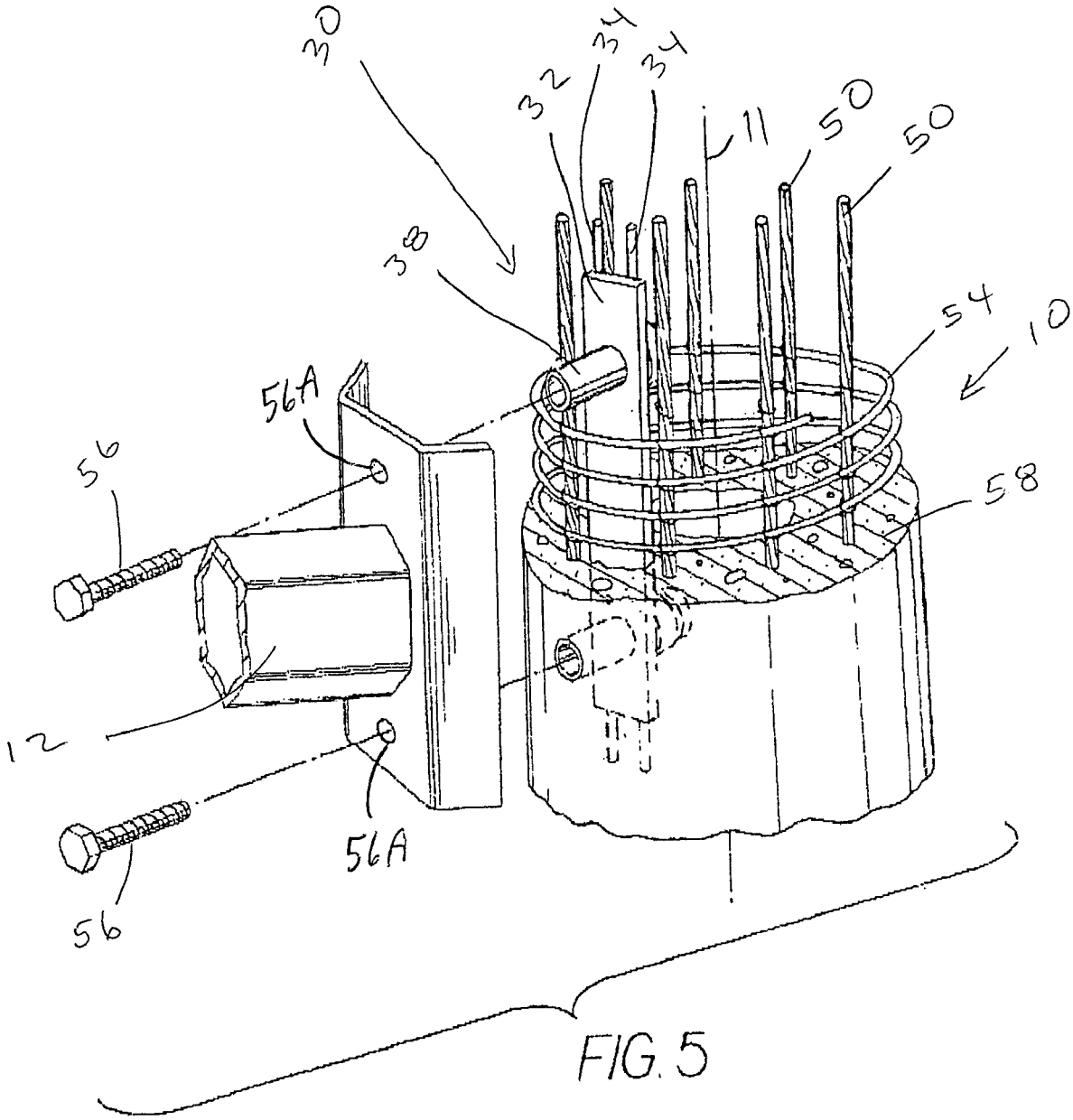
FIG. 5 is a broken-away perspective view, partially in section, of the concrete pole of FIG. 1.

As shown in FIG. 4, the outer shoulder 44 abuts the inner surface 32A of the base plate 32. The insert fastener 38 is secured, as by welding, to the base plate 32. In this particular prototype, the fastener insert 38 is made of ASTM A 36 steel, is machined and threaded, and has a two inch outside diameter at the enlarged annular portion 43.

The attachment mechanism 30 of FIG. 3 is inserted into the existing reinforcing members that are normally used in making a concrete pole 10 before the concrete is cast. Looking at FIGS. 4 and 5, it can be seen that the assembly includes the vertical reinforcing rods 50, which are spaced apart from each other, with all the reinforcing rods 50 being the same distance from the central axis 11 of the pole 10. The rods 50 extend the full length of the pole 10. While the rods 50 are referred to as vertical, they are actually at a slight angle to the vertical, to account for the taper of the pole 10. The spiral reinforcing wire 54 surrounds the vertical rods 50 and is tied to the rods 50. (The spiral wire 54 may be referred to as including a plurality of annular members, even though they do not exactly close to form a complete ring.) The rods 50 and spiral or annular members 54 form a cage.

The base plate 32 and the reinforcing bars 34 of the attachment mechanism 30 preferably are placed inside the spiral reinforcing wire 54, as shown here. The reinforcing bars 34 of the attachment mechanism may be tied to the spiral reinforcing wire 54. The base plate 32 preferably is welded to the reinforcing bars 34, as well as to the insert fasteners 38, before the attachment mechanism 30 is inserted inside the cage, and the base plate 32 is located so that the fastener inserts 38 project beyond the cage in order for their first ends 40 to be flush with the finished outer surface of the pole 10. Then the concrete is cast around the rods 50, the spiral wire 54, the reinforcing rods 34, the base plate 32, and the fastener inserts 38, preferably by spin casting. Several of the attachment mechanisms 30 of FIG. 3 may be installed at various elevations of the pole 10. In any case, the base plates 32 are installed so that the first ends 40 of the fasteners inserts 38 are substantially flush with the finished outer surface of the pole 10, so that their internal threaded surface 38A is accessible from outside the pole 10.

In order to attach an arm 12 or any other attachment 12 to the pole 10, bolts 56 are inserted through upper and lower holes 56A in the attachment 12 and are threaded into the internal threads 38A of the respective fastener inserts 38. The holes 56A in the attachment 12 have the same spacing as the holes 36 in the base plate 32, so they align directly with each other for bolting the attachment 12 to the pole 10.

The bolts 56 are very well supported by the structure of the pole 10 for several reasons. First, the base plate 32, on which the fastener insert 38 is fixed, is very well supported. The base plate 32 is prevented from moving in any direction by the concrete 58 that surrounds it and by the reinforcing rods 34, the vertical rods 50, the spiral wire cage 54, and the concrete 58 surrounding them. Furthermore, not only is the fastener insert 38 fully welded to the base plate 32, but the outer shoulder 44 on the fastener insert 38 abuts the inside surface 32A of the base plate 32, providing an even stronger joint which is unlikely to pull out of the pole 10. Since the bolts 56 are threaded into the fastener inserts 38 substantially over the entire length of the bolts 56, and preferably up to the finished outer surface of the pole 10, the bolts 56 are supported along their length, experiencing no cantilevered load, and making the attachment 12 stronger and less likely to fail.

Figure 9:
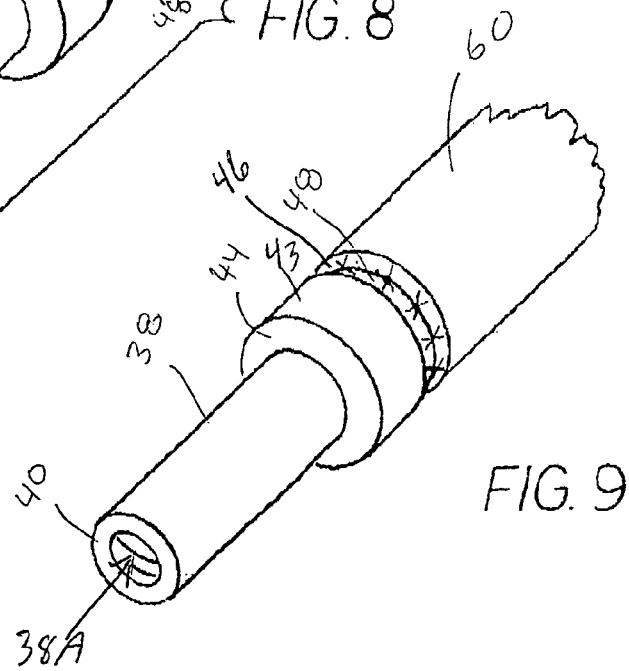
FIG. 9 is a broken away perspective view of the fastener and pipe of FIG. 8, as prepared for being joined with a full perimeter fillet weld.
Figure 10:
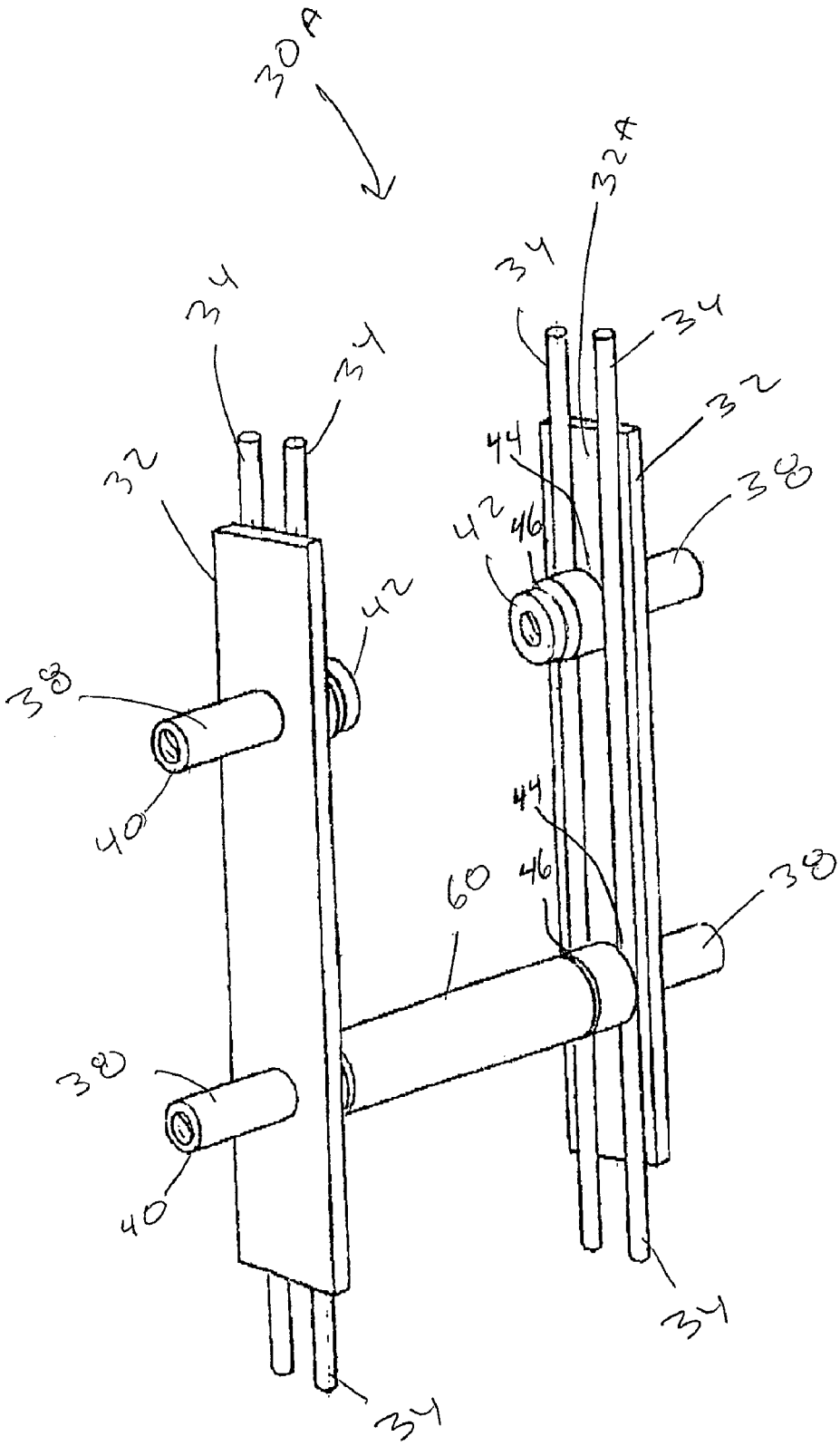
FIG. 10 is a perspective view of a second embodiment of a pole attachment mechanism made in accordance with the present invention, with the upper connecting pipe removed for illustration clarity.
Figure 11:
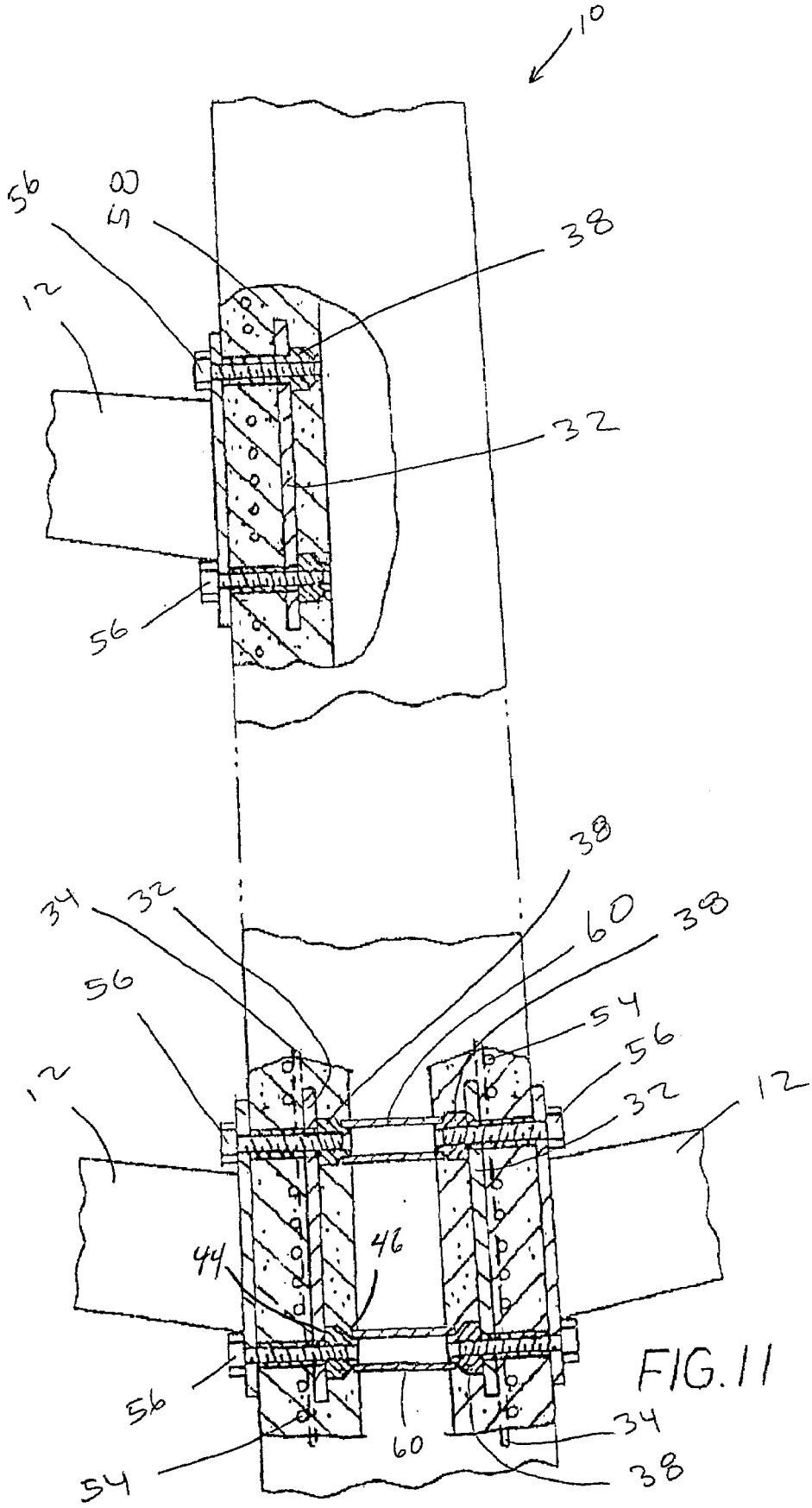
FIG. 11 is a broken-away portion, partially in section, of a pole made in accordance with the present invention, showing two different connecting mechanisms at different elevations on the pole.

FIGS. 8–11 show a second embodiment of an attachment mechanism 30A for a concrete pole made in accordance with the present invention. Referring briefly to FIG. 10, this second embodiment 30A comprises two of the attachment mechanisms 30 described above, which are diametrically opposed to each other and are joined by separators 60, which interconnect the respective second ends 42 of the opposing fastener inserts 38. In this preferred embodiment, the separators 60 are hollow pipes, although other rigid separator members could also be used. (The upper pipe 60 has been removed in FIG. 10 for clarity of illustration.)

The ends of the pipe 60 fit axially over the second ends 42 of the opposed fastener inserts 38. The pipe 60 slides over the second ends 42 of the fastener inserts 38 until the ends of the pipe 60 abut the inner shoulders 46 of the fastener inserts 38. The pipe 60 is then fixed, as by welding, to the respective fastener inserts 38. As shown in FIG. 9, the bevel edge 48 of the inner shoulder 46 allows for a full penetration fillet weld between the ends of the pipe 60 and the respective fastener inserts 38. Of course, the length of the pipe 60 is carefully selected based on the pole diameter at that elevation, so that the first ends 40 of the respective fastener inserts 38 are substantially flush with the finished outer surface of the concrete pole 10 when the pipe 60 is abutting the shoulders 46 of the corresponding fastener inserts 38.

Not only does this second embodiment provide a second attachment site for an arm 12, but the pipe 60 also provides additional strength to the attachment mechanism 30A. In a typical installation involving two bolts 56 affixing an arm 12, the upper bolt 56 is in tension as the weight of the arm 12 tries to pull it away from the pole 10, while the lower bolt 56 is under compression as the arm pushes in against the side of the pole 10. The pipe 60 helps transfer some of the tensile and compressive forces across from one side of the pole 10 to other side. Furthermore, if another arm 12 is mounted to the other side of the pole 10 (as shown in the bottom embodiment of FIG. 11), and if the loadings on both arms 12 are approximately equal, the pipe 60 itself bears much of the tensile or compressive force and tends to neutralize the loadings on the concrete portion of the pole.

Thus, the present invention provides a concrete pole with an attachment mechanism that is functionally far superior to the prior art. It will be obvious to those skilled in the art that modifications may be made to the embodiments described above without departing from the scope of the present invention.

What is claimed is:

1. A reinforced concrete pole, defining a central vertical axis, said pole comprising:

a reinforcing cage, including vertical reinforcing rods and annular members;

a first connector, including a first base plate having an inner surface directed toward said central vertical axis and an outer surface directed away from said central vertical axis;

a first hollow fastener, having first and second ends and defining internal threads, said first fastener being fixed to said first base plate with said first end directed toward said axis and said second end directed away from said axis and projecting outwardly from said first base plate; and concrete surrounding said reinforcing cage and said connector, said concrete defining an outer concrete surface, wherein the second end of said first hollow fastener lies adjacent to said outer concrete surface, and said internal threads extend at least part of the distance between said second end and said base plate, so that a bolt can enter the second end of said first hollow fastener from outside the pole and can be threaded into said first hollow fastener.

2. A reinforced concrete pole as recited in claim 1, wherein said first base plate lies inside said cage and extends across a plurality of said annular members.

3. A reinforced concrete pole as recited in claim 2, wherein said connector includes at least one vertical reinforcing bar fixed to said first base plate.

4. A reinforced concrete pole as recited in claim 1 wherein said first fastener defines a first shoulder between said first and second ends, and wherein said first shoulder abuts the inner surface of said first base plate.

5. A reinforced concrete pole as recited in claim 4, wherein said first fastener is welded to said first base plate at said first shoulder.

6. A reinforced concrete pole as recited in claim 5, and further comprising:

a second connector diametrically opposite said first connector, including a second base plate having inner and outer surfaces, with the outer surface of the second base plate lying adjacent the inside surface of said reinforcing cage; and a second hollow fastener defining internal threads and having first and second ends, said second fastener being fixed to said second base plate and projecting outwardly from said second base plate.

7. A reinforced concrete pole as recited in claim 6, and further comprising a separator having first and second ends, which are fixed to the first ends of said first and second hollow fasteners, respectively.

8. A reinforced concrete pole as recited in claim 7, wherein said separator is a pipe, which fits over the first ends of said first and second hollow fasteners.

9. A reinforced concrete pole as recited in claim 8, wherein said second fastener includes a first shoulder between said first and second ends, and wherein said first shoulder rests against said inside surface of said second plate.

10. A reinforced concrete pole as recited in claim 9, wherein said second fastener is welded to said second plate at said first shoulder.

11. A reinforced concrete pole as recited in claim 10, wherein each of said first and second fasteners has a second shoulder recessed from its first end, and said ends of said separator pipe abut said second shoulders.

12. A reinforced concrete pole defining a central vertical axis and comprising:

a reinforcing cage, including vertical reinforcing rods and annular members;

a connector, including a base plate having an inner surface directed toward said axis and an outer surface directed away from said axis, said base plate lying inside said reinforcing cage adjacent said annular members;

upper and lower hollow fasteners, each having an inner end and an outer end, and defining an outer shoulder fixed to the inner surface of said base plate, wherein said hollow fasteners project outwardly through and beyond said base plate; and concrete surrounding said reinforcing cage and said connector and defining an outer surface, wherein said upper and lower hollow fasteners extend substantially to said outer surface and define internal threads which are accessible from outside said pole and which extend a substantial distance between said base plate and said outer surface.

13. A reinforced concrete pole as recited in claim 12, and further comprising a pole attachment having a body defining upper and lower holes; and upper and lower bolts extending through said upper and lower holes and threaded into said upper and lower hollow fasteners, respectively.

14. A reinforced concrete pole as recited in claim 12, wherein said pole includes two of said connectors, diametrically opposed to each other, and further comprising at least one separator secured to the opposed lower hollow fasteners.

15. A reinforced concrete pole as recited in claim 14, and further comprising a second separator secured to the opposed upper hollow fasteners.

16. A reinforced concrete pole as recited in claim 15, wherein said separators are pipes, which telescope over the inner ends of their respective hollow fasteners.

17. A reinforced concrete pole as recited in claim 4, wherein said first base plate has an opening through which the first hollow fastener extends, and wherein the outside diameter of said first hollow fastener from said second end to said first shoulder is small enough to fit through said opening, and the outside diameter of said first shoulder is too large to fit through said opening.

18. A reinforced concrete pole as recited in claim 17, wherein said first hollow fastener also defines a second shoulder, located inwardly from said first shoulder, and wherein the outside diameter of said second shoulder is larger than the outside diameter of said first hollow fastener from said first end to said second shoulder.

19. A reinforced concrete pole as recited in claim 18, wherein said first hollow fastener defines a beveled surface portion between said second shoulder and said first end.

20. A reinforced concrete pole as recited in claim 19, and further comprising a separator pipe having one end which is telescoped over the first end of the first fastener and which is secured to said first fastener at said beveled surface portion.

* * * * *